US005609078A

United States Patent [19]

Yang

[11] Patent Number: 5,609,078

[45] Date of Patent: Mar. 11, 1997

[54] HIGH-TORSION RATCHET MECHANISM ASSEMBLY FOR A RATCHET SCREWDRIVER

[76] Inventor: Tsung-Hsun Yang, No. 2, Lane 108, Yung-Feng Rd., Tai-Ping Hsiang, Taichung Hsien, Taiwan

[21] Appl. No.: 527,637

[22] Filed: Sep. 13, 1995

[51] Int. Cl.[6] ..... B25B 13/46

[52] U.S. Cl. ..... 81/63.1; 192/43.2

[58] Field of Search ..... 8/60, 63.1; 192/43, 192/43.2

[56] References Cited

U.S. PATENT DOCUMENTS 4,488,460 12/1984 Ballone et al. ..... 81/60

4,777,852 10/1988 Herman et al. ..... 81/63.1

*Primary Examiner*—James G. Smith

*Attorney, Agent, or Firm*—Foley & Lardner

[57] ABSTRACT

A ratchet mechanism assembly for a ratchet screwdriver includes a cylindrical casing, a rotatable drive shaft, a pair of annular pawl members, a spring unit, and an actuator. The casing has an annular surrounding wall that defines a receiving space therein. The drive shaft has a fixed ratchet wheel journalled within the receiving space. The pawl members are disposed within the receiving space of the casing. Each of the pawl members has a pawl projection projecting from an inner periphery thereof. The spring unit biases the pawl members to cause the pawl projections to engage the ratchet wheel, in such a manner that a tooth of the ratchet wheel is located between the projections in order to prevent rotation of the ratchet wheel relative to the casing. The actuator can be moved to a first position, wherein the pawl projection of one of the pawl members disengages the ratchet wheel to permit rotation of the shaft in the casing in a first direction, and a second position, wherein the pawl projection of the other one of the pawl members disengages the ratchet wheel to permit rotation of the shaft in the casing in a second direction opposite to the first direction.

3 Claims, 6 Drawing Sheets

HIGH-TORSION RATCHET MECHANISM ASSEMBLY FOR A RATCHET SCREWDRIVER

BACKGROUND OF THE INVENTION

1. Field of the Invention

The invention relates to a ratchet screwdriver, more particularly to a high torsion ratchet mechanism assembly for a ratchet screwdriver.

2. Description of the Related Art

Referring to FIGS. 1 to 3, the ratchet mechanism assembly of a conventional ratchet screwdriver is shown to comprise a ratchet housing which includes an elongated substantially cylindrical housing portion 10 having a central bore 101, and an integral extension 102 that projects rearwardly from a closed end of the housing portion 10 and is connected securely to an elongated handle (not shown) of the ratchet screwdriver. The outer surface of the housing portion 10 has a generally I-shaped slot 103 with a transverse rear section 104, and a transverse front section 105. A rotatable drive shaft 11 has a front portion that extends into the bore 101 via an open end of the housing portion 10. A ratchet wheel 110 is connected securely on the front portion of the drive shaft 11. Two ratchet pawls 12 are positioned in the slot 103 in such a manner that wide end portions 121 of the former are received within the transverse front and rear sections 104, 105. Each of the ratchet pawls 12 has a finger portion 122 that extends along the axial section of the slot 103. The ratchet pawls 12 can be engaged with or disengaged from the ratchet wheel 111 by moving a slidable thumb actuator 1 provided within the slot 103 of the housing portion 10. A stop 13 is received in the front section 105 of the slot 103 to abut on the end surface of the ratchet wheel 111 and prevent axial movement of the drive shaft 11 in the housing portion 10.

When assembled, a cylindrical sleeve 3 is slidably mounted on and circumferentially encloses the ratchet housing 10 and the ratchet mechanism therein. A bushing 4 is then installed to close the open end of the housing portion 21.

Because the size of the ratchet screwdriver is relatively small, the contact area between the finger portions 122 of the ratchet pawls 12 and the ratchet wheel 111 is correspondingly small. The conventional ratchet mechanism assembly is thus unsuitable for high-torsion applications. Furthermore, assembly of the conventional ratchet mechanism assembly is inconvenient and relatively complicated.

SUMMARY OF THE INVENTION

The object of the present invention is to provide a ratchet screwdriver having a ratchet mechanism assembly that can produce high-torsion and that can be easily assembled.

Accordingly, a ratchet mechanism assembly for a ratchet screwdriver includes a cylindrical casing, a rotatable drive shaft, a pair of annular pawl members, a spring unit, and an actuator. The casing has an annular surrounding wall defining a receiving space therein, the casing being adapted to be connected securely to an elongated handle of the ratchet screwdriver. The drive shaft has a fixed ratchet wheel journalled within the receiving space of the casing. The pawl members are disposed within the receiving space of the casing and are sleeved movably on the ratchet wheel. Each of the pawl members has a pawl projection projecting from an inner periphery thereof. The pawl projections of the pawl members are spaced apart from each other to define a gap therebetween. The spring unit biases the pawl members so that the pawl projections engage the ratchet wheel in such a manner that a tooth of the ratchet wheel is located in the gap to prevent rotation of the ratchet wheel relative to the casing. The actuator is disposed operatively on the casing and can be moved to a first position, wherein the pawl projection of one of the pawl members disengages the ratchet wheel to permit rotation of the shaft in the casing in a first direction, and a second position, wherein the pawl projection of the other one of the pawl members disengages the ratchet wheel to permit rotation of the shaft in the casing in a second direction opposite to the first direction.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
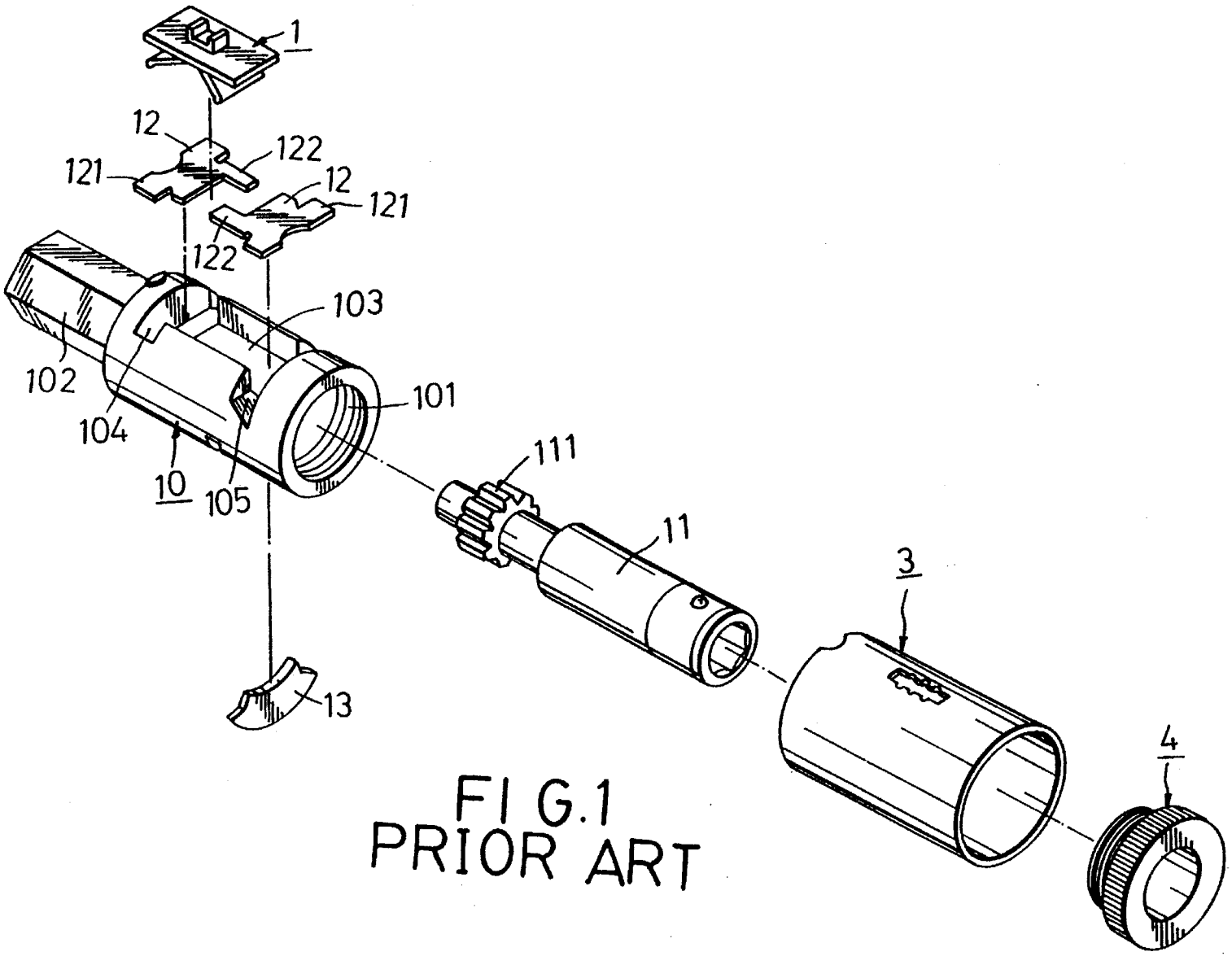
FIG.1 PRIOR ART
FIG. 1 is an exploded view of a conventional ratchet mechanism assembly for a ratchet screwdriver.
Figure 2:
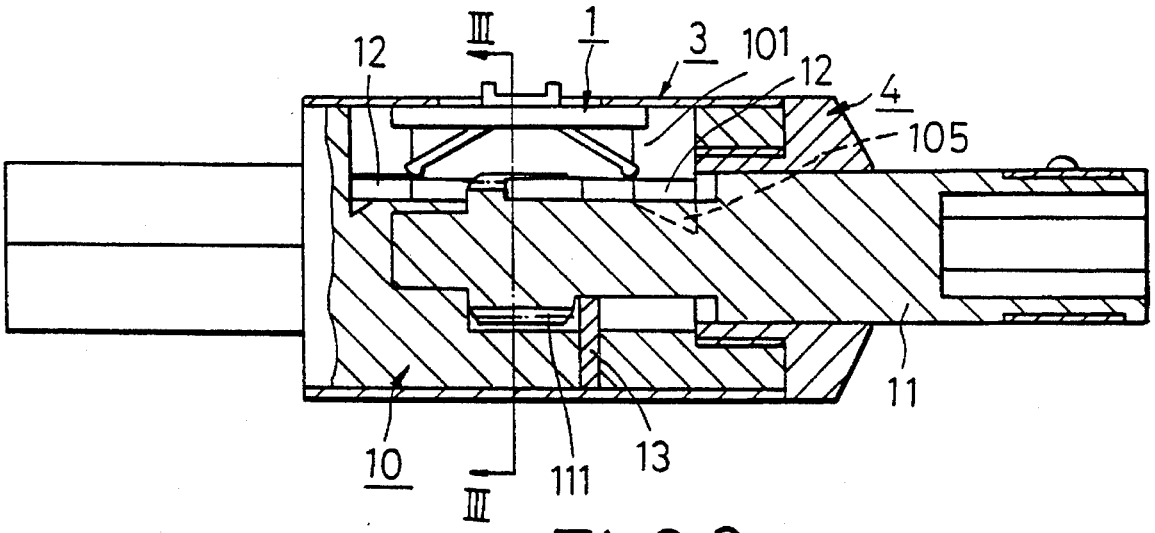
FIG.2 PRIOR ART
FIG. 2 is a sectional view of the conventional ratchet mechanism assembly shown in FIG. 1.
Figure 3:
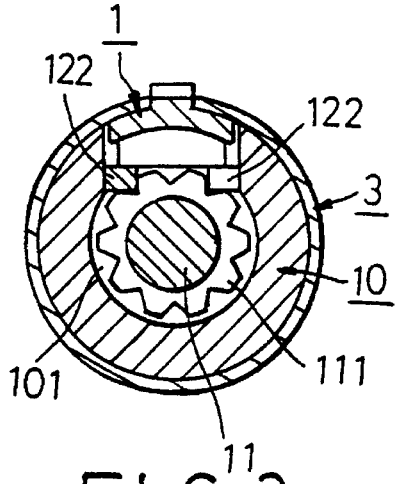
FIG.3 PRIOR ART
FIG. 3 is a sectional view taken along line III—III of FIG. 2.
Figure 4:
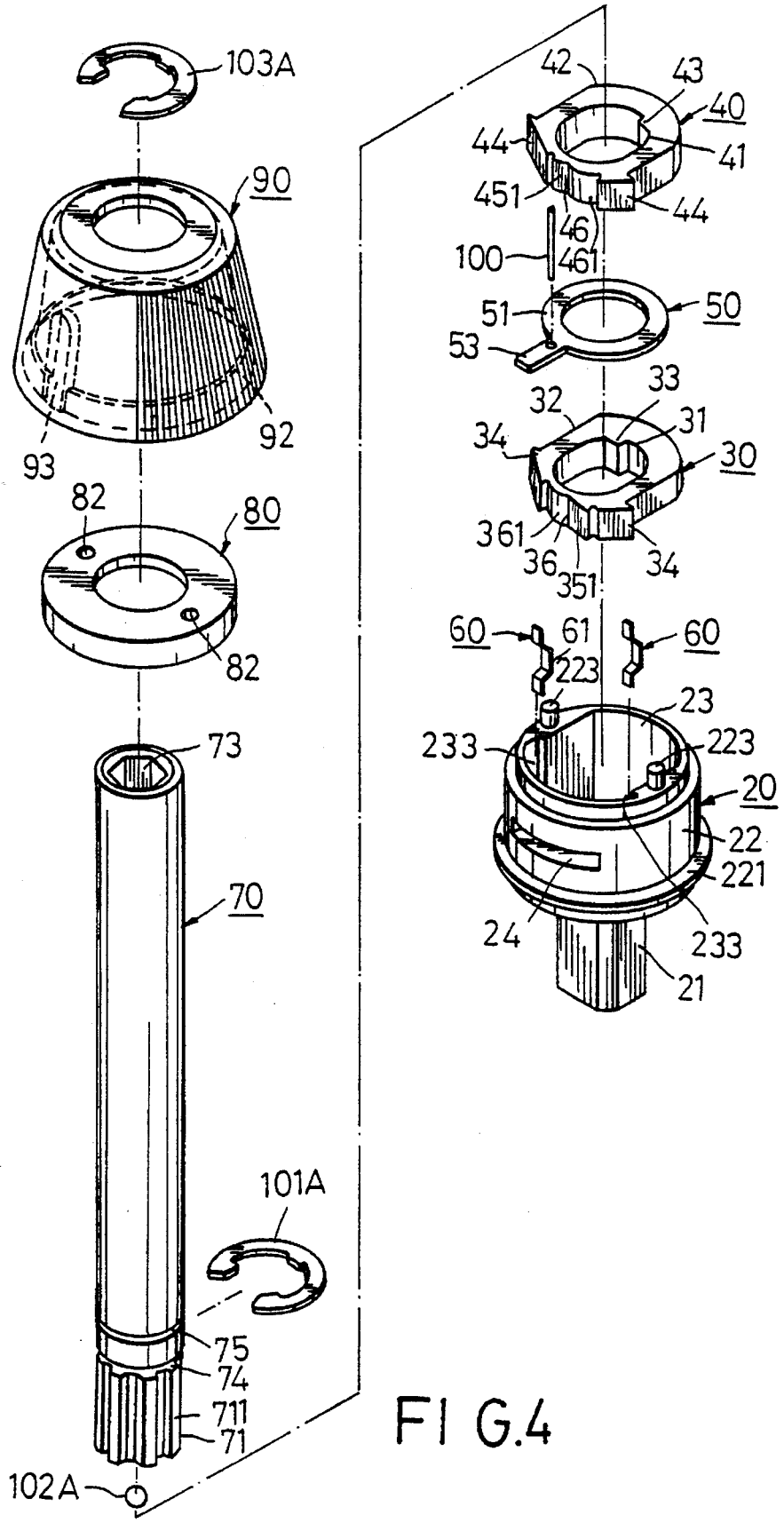
FIG. 4 is an exploded view of a ratchet mechanism assembly for a ratchet screwdriver according to the present invention.

Referring to FIG. 4, the preferred embodiment of a ratchet mechanism assembly for a ratchet screwdriver in accordance with the present invention is shown to include a cylindrical casing 20, a pair of annular pawl members 30, 40, an annular actuator 50, a spring unit 60, a rotatable drive shaft 70, an annular cover disk 80, and a truncated conical adjustment member 90.

As illustrated, the casing 20 has an annular surrounding wall 22 which defines a receiving space 23 therein and which has a circumferentially extending slot 24 formed through the surrounding wall 22 and communicated with the receiving space 23, and a connecting portion 21 adapted to be connected securely to an elongated handle of the ratchet screwdriver.

The drive shaft 70 has a lower end portion provided with a fixed ratchet wheel 71 journalled within the receiving space 23 of the casing 20, and an upper end portion provided with an axially extending tool-bit holding bore 73.

Figure 7:
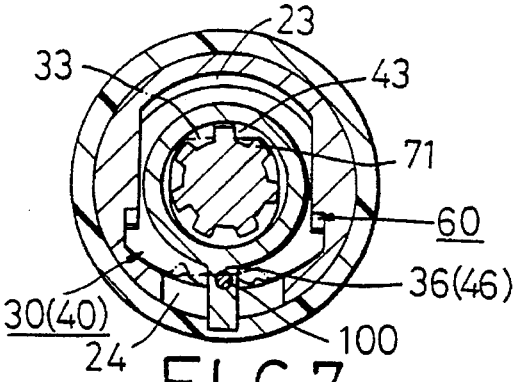
FIG. 7 is a cross sectional view of the ratchet mechanism assembly for a ratchet screwdriver of the present invention, illustrating the ratchet screwdriver when functioning as an ordinary screwdriver.

The pawl members 30, 40 are disposed within the receiving space 23 of the casing 20 and are sleeved movably on the ratchet wheel 71. Each of the pawl members 30, 40 has a pawl projection 33, 43 projecting from an inner peripheral surface 31, 41 thereof, and an outer peripheral surface 34, 44 formed with two different cam faces 351, 361, 451, 461 adjacent to the slot 24. As best shown in FIG. 7, the pawl projections 33, 43 are spaced apart from each other so as to define a gap therebetween.

The spring unit 60 includes two substantially U-shaped springs 61, each of which is disposed between one of the vertical flat surfaces 233 of the casing 20 and one of the outwardly extending projections on the pawl members 30, 40 to bias the pawl projections 33, 43 to engage the ratchet wheel 71 in such a manner that a tooth 711 of the ratchet wheel 71 is located in the gap and to prevent rotation of the ratchet wheel 71 relative to the casing 20.

The actuator 50 is disposed operatively on the casing 20 and includes a circular ring 51 sleeved rotatably around the shaft 70 and located between the pawl members 30, 40, a radially extending rotary lever 53 secured integrally to the circular ring 51 and extending from the casing 20 through the slot 24 so as to rotate along the slot 24, and an axially extending push rod 100 secured to the rotary lever 53 and located in the positioning grooves 36, 46 (see FIG. 7) formed between the cam faces 351, 361, 451, 461 of the pawl members 30, 40.

The cover disk 80 is sleeved around the drive shaft 70 and has two mounting holes 82 that permit extension of the vertically extending tabs 223 of the casing 20 into the holes 82, thereby covering the receiving space 23 of the casing 20.

The adjustment member 90 is sleeved rotatably around the drive shaft 70 and has an inner surface formed with an axial groove 93 to permit extension of a distal end of the rotary lever 53 of the actuator 50 into the groove 93, and an annular groove 92 which, engages the outwardly extending flange portion 221 of the casing 20. Thus, the rotary lever 53 and the push rod 100 of the actuator 50 can rotate synchronously with the adjustment member 90 when the latter is rotated about the drive shaft 70. Two C-shaped retaining rings 101A, 103A are sleeved in the circumferential grooves 74, 75 of the drive shaft 70 in order to prevent disengagement of the adjustment member 90 and the drive shaft 70 from the cylindrical casing 20.

Referring to FIG. 7, after the components of the ratchet mechanism assembly of this invention have been assembled, the rotary lever 53 is located at a normal position, in the grooves 36, 46 formed between the cam faces 351, 361, 451, 461. Under this condition, the ratchet screw driver of this invention functions as an ordinary screwdriver.

Figure 8:
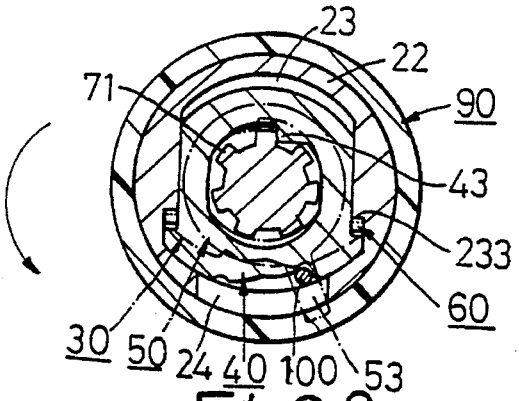
FIG. 8 is a cross sectional view of the ratchet mechanism assembly for a ratchet screwdriver of the present invention, illustrating a situation where the ratchet screwdriver is rotatable in a first direction so as to generate a large torsional force.
Figure 9:
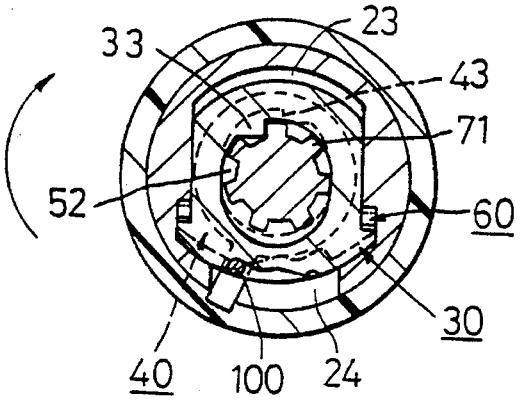
FIG. 9 is a cross sectional view of the ratchet mechanism assembly for a ratchet screwdriver of the present invention., illustrating a situation where the ratchet screwdriver is rotatable in a second direction opposite to the first direction so as to generate a large torsional force.

As illustrated in FIG. 8, the adjustment member 90 can be moved to a first position, wherein the pawl projection 33 of one of the pawl members 30 disengages from the ratchet wheel 71 to permit rotation of the shaft 70 in the casing 20 in a first direction (a counter-clockwise direction), and a second position, wherein the pawl projection 43 of the other one of the pawl members 40 disengages the ratchet wheel 71 to permit rotation of the shaft 70 in the casing 20 in a second direction (clockwise direction), as shown in FIG. 9.

Figure 5:
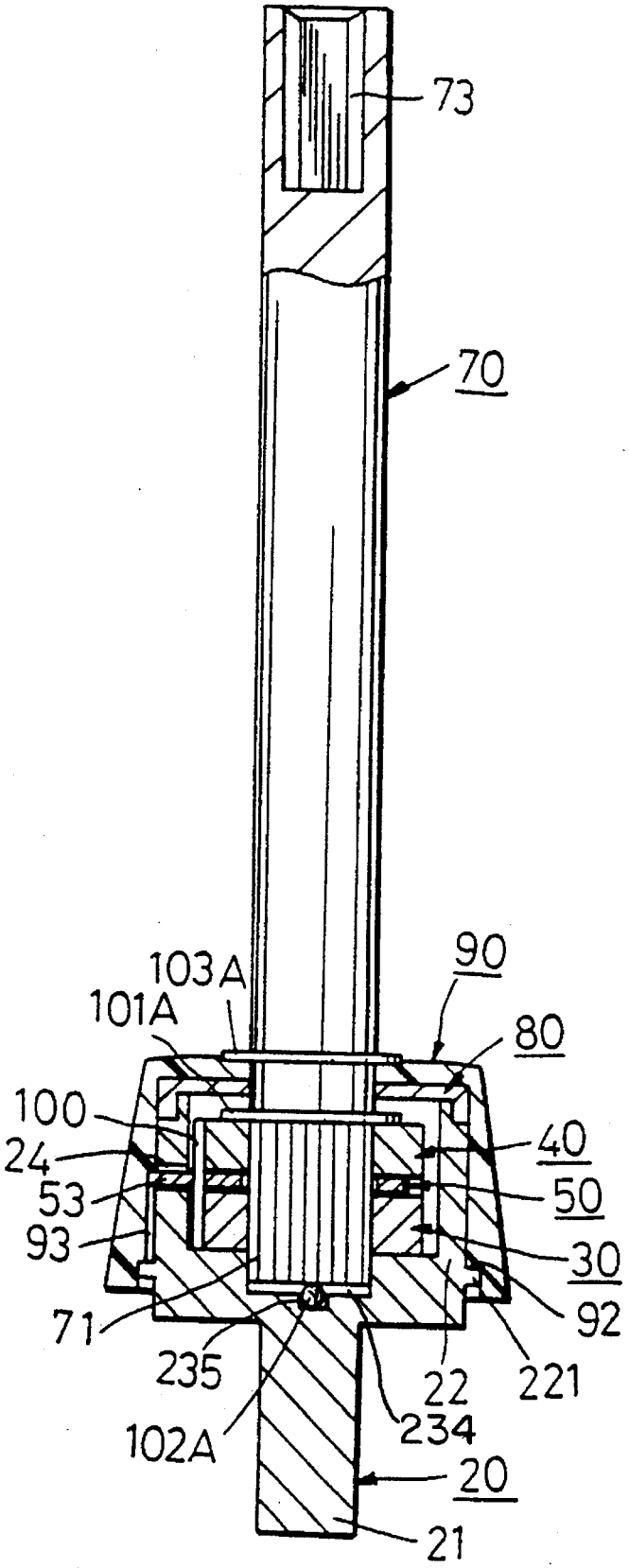
FIG. 5 is a sectional view of the ratchet mechanism assembly for a ratchet screwdriver shown in FIG. 4.
Figure 6:
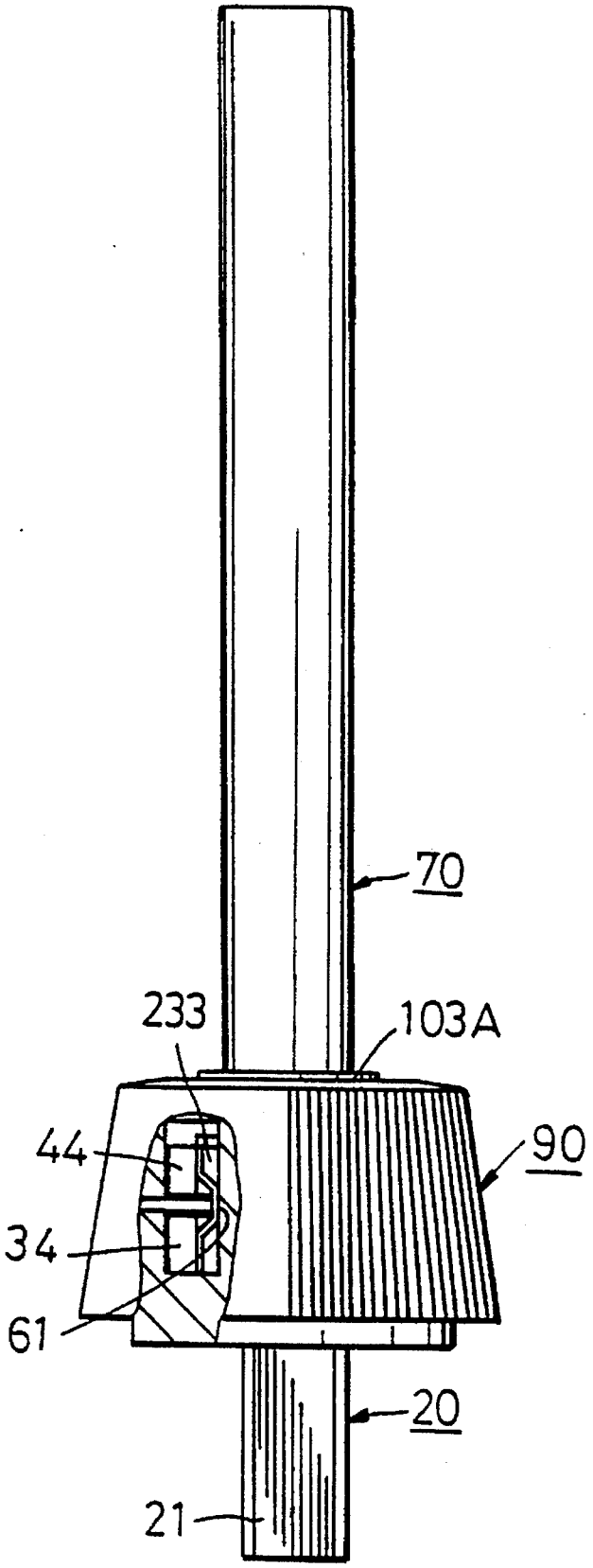
FIG. 6 is a partially sectional view of the ratchet mechanism assembly for a ratchet screwdriver shown in FIG. 4.

Referring to FIG. 5, in the preferred embodiment, the ratchet mechanism assembly of the present invention further includes a bearing unit interposed between the drive shaft 70 and the casing 20 to reduce friction between the shaft 70 and the casing 20. The shaft 70 has a circular engaging surface 234. The casing 20 has a circular cavity 235 formed in a central portion thereof. The bearing unit includes a ball 102A located between the circular engaging surface 234 of the shaft 70 and the casing 20 and engaged with the cavity 235.

With the present invention thus explained, it is obvious to those skilled in the art that various modifications and variations can be made without departing from the scope and spirit thereof. It is therefore intended that the invention be defined as set forth in the appended claims.

I claim:

1. A ratchet mechanism assembly for a ratchet screwdriver, comprising:

a substantially cylindrical casing having a substantially annular surrounding wall defining a receiving space therein, the casing being adapted to be connected securely to an elongated handle of said ratchet screwdriver;

a drive shaft having a fixed ratchet wheel rotatably journalled within said receiving space of said cylindrical casing;

a pair of annular pawl members disposed within said receiving space of said cylindrical casing and sleeved movably on said ratchet wheel, each of said pawl members having a pawl projection projecting from an inner periphery thereof, said pawl projections of said pawl members being spaced apart from each other to define a gap therebetween;

a spring unit biasing said pawl projections of said pawl members to engage said ratchet wheel so that a tooth of said ratchet wheel is located in said gap to prevent rotation of said ratchet wheel relative to said casing; and an actuator disposed operatively on said cylindrical casing and being movable between a first position, where said pawl projection of one of said pawl members disengages said ratchet wheel to permit rotation of said shaft in said casing in a first direction, and a second position, where said pawl projection of the other one of said pawl members disengages said ratchet wheel to permit rotation of said shaft in said casing in a second direction opposite to the first direction, wherein said surrounding wall has a circumferentially extending slot formed therethrough and communicated with said receiving space, each of said pawl members having an outer peripheral surface formed with a cam face adjacent to said slot, said actuator including a circular ring sleeved rotatably around said shaft and located between said pawl members, a radially extending rotary lever secured to said circular ring and extending from said casing through said slot so as to rotate along said slot, and an axially extending push rod secured to said rotary lever and located between said cam faces of said pawl members, rotation of said rotary lever to said first position causing said push rod to engage one of said cam faces and pushing said pawl projection of one of said pawl members to disengage from said ratchet wheel, while rotation of said rotary lever to said second position causing said push rod to engage the other one of said cam faces and pushing said pawl projection of the other one of said pawl members to disengage from said ratchet wheel.

2. The ratchet mechanism assembly as defined in claim 1, further comprising a truncated conical adjustment member sleeved rotatably around said drive shaft, said adjustment member having an inner surface formed with an axial groove to permit extension of a distal end of said rotary lever into said groove, thus permitting synchronous rotation of said adjustment member with said rotary lever and said push rod.

3. The ratchet mechanism assembly as defined in claim 1, further comprising a bearing unit interposed between said shaft and said casing to reduce friction between said shaft and said casing, said shaft having a circular engaging surface, said casing having a cavity, said bearing unit including a ball bearing located between said engaging surface of said shaft and said casing, within said cavity of said casing.

* * * * *